United States Patent [19]

Smith

[11] Patent Number: 4,878,449

[45] Date of Patent: Nov. 7, 1989

[54] SAFETY DEVICE FOR WATER SKIING

[76] Inventor: Stephan J. Smith, 15662 Park La., Livonia, Mich. 48154

[21] Appl. No.: 278,356

[22] Filed: Dec. 1, 1988

[51] Int. Cl.[4] ..... B63B 21/56

[52] U.S. Cl. ..... 114/253; 294/82.33

[58] Field of Search ..... 114/252–254, 114/242, 249; 441/68, 69; 294/82.31, 82.33; 24/230.5 R, 231, 241 P, 241 PP, 241 PS, 241 SP, 241 SB

[56] References Cited

U.S. PATENT DOCUMENTS

| | | | |
|---|---|---|---|
| 2,943,591 | 7/1960 | Schneider | 114/253 |
| 3,110,331 | 11/1963 | Buchanan | 114/252 |
| 3,405,966 | 10/1968 | Harley | 294/82.33 |
| 3,493,260 | 2/1970 | Smith | 294/82.33 |
| 4,233,923 | 11/1980 | Casad et al. | 114/252 |

*Primary Examiner*—Sherman D. Basinger
*Assistant Examiner*—Edwin L. Swinehart
*Attorney, Agent, or Firm*—Harness, Dickey & Pierce

[57] ABSTRACT

A safety release device for water skiing, wherein the ski rope can be quickly disengaged from the transom of the boat through the actuation of a pull cord by a safety observer in the boat, which actuating of the pull cord releases the ski towing rope from the rear transom connection to the boat.

5 Claims, 1 Drawing Sheet

SAFETY DEVICE FOR WATER SKIING

BACKGROUND OF THE INVENTION

This invention generally relates to a safety release device for use in water skiing. More particularly, the invention relates to a safety release device whereby the tow rope held by the skier can be quickly released if or when the skier falls into the water, thereby necessitating for any reason that the tow rope be quickly released from the boat, such that the skier can avoid possible injury which might be caused if the rope remains attached.

In the past, the activity of water skiing has involved a skier who is pulled by a tow rope, with the tow rope being attached to a speed boat, power boat, or outboard motorized boat of the well known type used to pull water skiers. Water skiers are often involved in trick skiing or expert skiing wherein the water skier, for example, is pulled by placing one foot in a small harness arrangement positioned in the handle of the ski rope. Such small harness arrangements used to tow the water skier by the foot, or by other holding arrangements not involving the actual hands of the water skier, can involve the risk of possible injury, if and when the water skier falls, and the small harness arrangement does not release the foot or other body limb from being pulled by the ski boat. If the water skier is extensively pulled by the ski boat while still attached to the foot holding harness in the handle of the ski rope, then possible injury may result. Other safety release mechanisms have been proposed in the past to release the water skier in such a situation; however, such prior safety release mechanisms have involved release devices which are mounted generally on a tripod arrangement which is located in the central cockpit of the boat. These prior safety release mechanisms, located on a tripod in the central cockpit of the boat, are quite expensive and rather difficult and bulky to work with. Accordingly, for many years past, there has been a need for an easy, convenient and efficiently workable safety release device for water skiers, which could be attached at or near the rear transom of the boat.

Accordingly it is a primary object of this invention to provide an improved safety release mechanism for use in water skiing.

Another object of the present invention is to provide a new safety release device which can be used at or near the rear transom of the boat which pulls the water skier.

Another object of the present invention is to provide a new and unique safety release assembly, which is floatable, and which is relatively inexpensive and easy to manufacture.

Other objects, features and advantages of the present invention will become apparent from the subsequent description and the appended claims taken in conjunction with the accompanying drawings.

SUMMARY OF THE INVENTION

Briefly stated the present invention comprises a safety release assembly for water skiing, said assembly comprising, a tow harness rope mounted across the rear transom of a boat, a block-like means mounted at its one end on the harness rope for slidable movement back and forth across the harness rope, said block means at its other end having a spring-loaded finger means for engaging and pulling a ski rope which at its other end is held by a skier, said finger means being held in fixed position during actual water skiing by, a movable hinge-like means which engages and holds the finger means in a closed condition during continued water skiing, a pull cord means attached to the movable hinge means and operative such that upon pulling of the cord means the hinge member is disengaged from the finger means to thereby release the ski rope from any attachment to the boat.

In another aspect, briefly stated, the present invention comprises a safety release assembly for water skiing, said assembly comprising, a tow harness member mounted across the rear transom of a boat, a block-like means for mounting on the harness for slidable movement back and forth across the harness, said block means having a spring-loaded means for engaging and pulling a ski rope which is held by a skier, said spring-loaded means being held in fixed position during actual water skiing by, a movable release member means which engages and holds the spring-loaded means in a closed condition during continued water skiing, a triggering means attached to the movable release member means and operative such that upon actuating said triggering means the release member means is disengaged from the spring-loaded means to thereby release the ski rope from any attachment to the boat.

DESCRIPTION OF PREFERRED EMBODIMENTS

Figure 1:
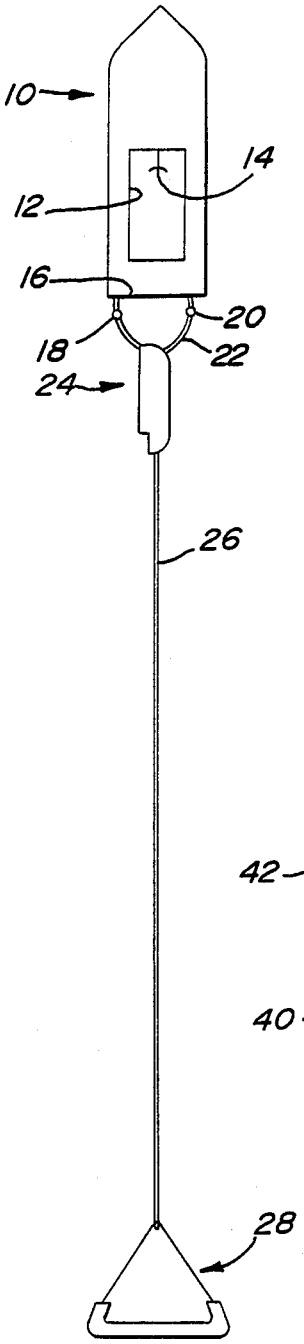
FIG. 1 generally describes a top schematic plan view of the invention.

FIG. 1 illustrates a general plan view of the invention, wherein a power boat or speed boat designated 10 is shown, which has a cockpit 12 and steering wheel 14. At the rear transom 16 of the boat, there are positioned two ring hitches 18 and 20. These ring hitches hold a harness rope 22 which is positioned laterally across the rear transom 16 of the boat.

Mounted on the harness rope 22 is a special safety release device 24, to be described further hereinafter. At the other end of the safety release device 24 there is attached a ski rope 26 which extends out a substantial distance behind the boat 10 to a ski handle portion 28 which is grasped and held by the skier during water skiing.

The safety release device 24 is made from a block-like member or block-like means 30. The block-like member 30 has a pulley 32 mounted at one end thereof, with said pulley acting to permit slidable movement of the block member 30 back and forth across the transom rope 22 mounted at the rear of the boat 10.

At the opposite end of the block member 30, that is, at the opposite end from the pulley 32, there is mounted a spring-loaded curved finger member designated 34 which rotates about the pin member 36. The finger member 34 engages a loop 38 at the end of the ski rope 26 and thereby functions to hold the ski rope 26 during pulling of the skier by the ski boat 10. The finger member 34 is held in locked position by insertion in the aperture 39 of the hinge member 40 which pivots about the hinge pin 42. The finger meber 34 is also spring biased by the spring 44, such that when the finger member 34 is released by a person in the ski boat who pulls the pull cord 46 in the direction indicated by the arrow 48, then the hinge member 40 which engages the finger member 34 is pulled away from the finger 34 such that the finger 34 is released and pulled back to the right by the spring member 44, thus releasing the ski rope 26 from the forward pulling action of the boat.

The new safety release device 24 described herein acts to release the ski rope 26 from the finger member 34, and such action is carried out when the water skier falls or it is desired to release the ski rope 26 from the pulling action of the boat 10 at any time. The device is highly advantageous, in particular, for usage by water skiers who utilize advanced techniques of holding the handle of the ski rope 26 by placing one foot in a special foot harness(not shown) placed within the handle. When such a water skier falls accidentally, it is often difficult to release the foot from said harness; and possible injuries can occur if the boat drags the skier too far before he(she) is released. With the mechanism of this invention, a safety observer in the boat(besides the driver) can immediately detect if the skier has fallen, and then release the ski rope 26 by pulling on the pull cord 46(as shown by the direction of the arrow 48).

Figure 3:
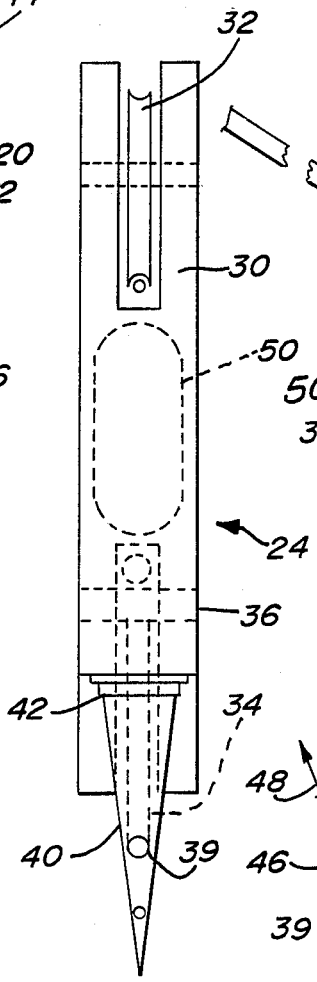
FIG. 3 is a side view taken from the left side shown in FIG. 2.
Figure 2:
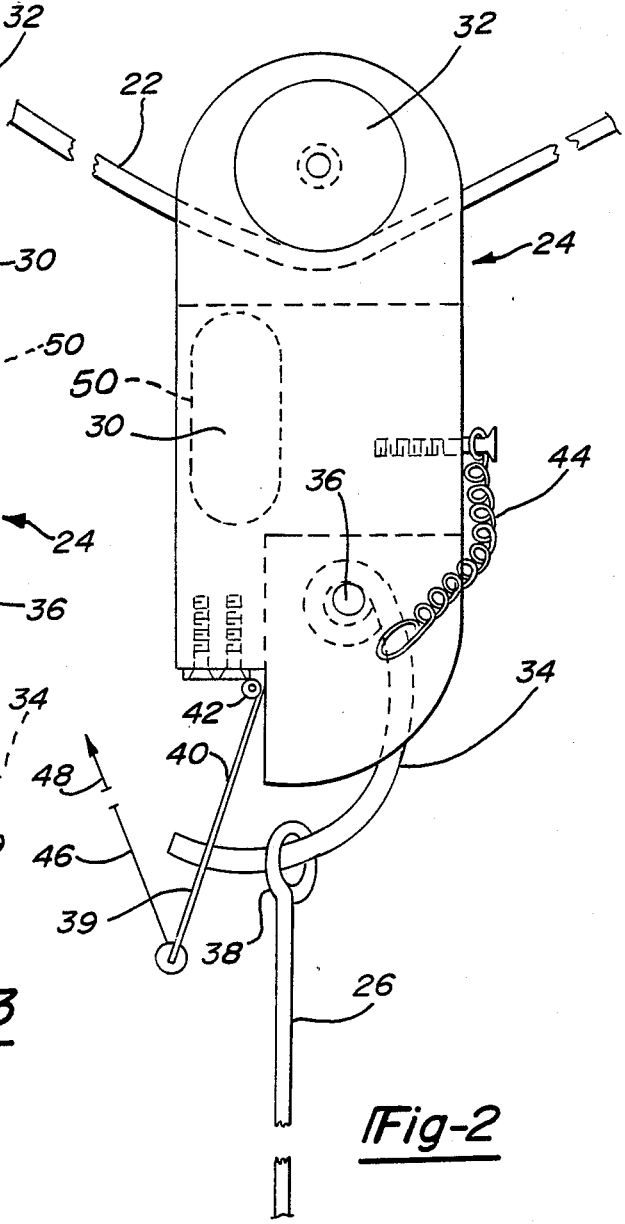
FIG. 2 is a top plan view of the safety release device of the invention.

By the term block-like member or block-like means as used herein it is meant a member which can generally be made of either wood or plastic or any other suitable material having sufficient strength to carry out the functions as described herein; and it is also meant that the material should be floatable in water such that the block-like member will not sink into the propeller area of the boat. If desired the block-like member can have a hollow portion designated 50 in FIG. 3 such that the hollow portion of the block-like member will assist in rendering the block floatable in water.

While it will be apparent that the preferred embodiments of the invention disclosed are well calculated to fulfill the objects, benefits, and advantages of the invention, it will be appreciated that the invention is susceptible to modification, variation and change without departing from the proper scope or fair meaning of the subjoined claims.

What is claimed is:

1. A safety release assembly for water skiing, said assembly comprising:

a tow harness rope mounted across a rear transom of a boat, a block-like means mounted at its one end on the harness rope for slidable movement back and forth across the harness rope, said block-like means at its other end having a spring-loaded finger means for engaging and pulling a ski rope which at its other end is held by a skier, said finger means being held in fixed position during actual water skiing by a movable hinge-like means which engages and holds the finger means in a closed condition during continued water skiing, a pull cord means attached to the movable hinge-like means and operative such that upon pulling of the cord means the hinge-like means is disengaged from the finger means to thereby release the ski rope from any attachment to the boat.

2. The assembly of claim 1 wherein, said block-like means is floatable to thereby assist in preventing the assembly from sinking below water level and getting caught in a propeller of the boat.

3. The assembly of claim 2 wherein, said block-like means has a pulley mounted at one end thereof, said pulley engaging the transverse mounted harness rope for slidable back and forth movement thereon, and the other end thereof having a pin transversely mounted through the block-like means, with said pin acting to support the spring loaded finger means for rotational movement.

4. A safety release assembly for water skiing, said assembly comprising:

a tow harness member mounted across a rear transom of a boat, a block-like means for mounting on the harness for slidable movement back and forth across the harness, said block-like means having a spring-loaded means for engaging and pulling a ski rope which is held by a skier, said spring-loaded means being held in fixed position during actual water skiing by, a movable release member means which engages and holds the spring-loaded means in a closed condition during continued water skiing, a triggering means attached to the movable release member means and operative substantially upon demand such that upon actuating said triggering means the release member means is disengaged from the spring-loaded means to thereby release the ski rope from any attachment to the boat.

5. The assembly of claim 4 wherein, said block-like means is floatable.

* * * * *